US008454391B2

(12) United States Patent
Hsiao et al.

(10) Patent No.: US 8,454,391 B2
(45) Date of Patent: Jun. 4, 2013

(54) POWER ELECTRICAL CONNECTOR WITH IMPROVED METAL SHELL

(75) Inventors: Yu-San Hsiao, New Taipei (TW); Tsu-Yang Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 138 days.

(21) Appl. No.: 13/187,514

(22) Filed: Jul. 21, 2011

(65) Prior Publication Data

US 2012/0021652 A1 Jan. 26, 2012

(51) Int. Cl.
*H01R 24/00* (2011.01)

(52) U.S. Cl.
USPC ..... 439/626

(58) Field of Classification Search
USPC ..... 439/626, 607.05, 607.07, 607.09, 439/607.46, 660, 218
See application file for complete search history.

(56) References Cited

U.S. PATENT DOCUMENTS

| | | | | |
|---|---|---|---|---|
| 2011/0130019 | A1* | 6/2011 | Lim et al. | 439/626 |
| 2012/0009822 | A1* | 1/2012 | Ho | 439/626 |
| 2012/0021651 | A1* | 1/2012 | Ho | 439/626 |
| 2012/0030146 | A1* | 2/2012 | Crighton | 439/626 |

* cited by examiner

*Primary Examiner* — Jean F Duverne
(74) *Attorney, Agent, or Firm* — Wei Te Chung; Ming Chieh Chang

(57) ABSTRACT

An electrical connector includes a metal shell, an insulative housing and at least one terminal retained in the insulative housing. The metal shell defines a front-to-rear direction and a lateral direction perpendicular to the front-to-rear direction and includes a pair of elastic arms extending rearward from a rear edge thereof and a pair of latch portions extending along the lateral direction from free tips of the elastic arms. The insulative housing comprises a base portion and a mating portion extending forwardly from the base portion. The base portion defines a pair of protrusions extending along the lateral direction. The terminal includes a contact portion disposed on the mating portion. The metallic shell is assembled to the insulative housing in the front-to-rear direction. The latch portions of the metal shell lock with the protrusions of the housing so as to secure the shell to the insulative housing.

10 Claims, 6 Drawing Sheets

POWER ELECTRICAL CONNECTOR WITH IMPROVED METAL SHELL

FIELD OF THE INVENTION

The present invention generally relates to an electrical connector, and more particularly to a power electrical connector with an improved metal shell.

DESCRIPTION OF PRIOR ART

Conventionally, an electrical connector comprises an insulative housing, a number of terminals retained in the insulative housing and a metal shell enclosing the insulative housing. However, it is difficult to mount the metal shell onto the insulative housing. On the other hand, the engagement between the metal shell and the insulative housing is not liable in use.

Hence, an improved electrical connector is highly desired to overcome the aforementioned problems.

SUMMARY OF THE INVENTION

The present invention provides An electrical connector includes a metal shell, an insulative housing and at least one terminal retained in the insulative housing. The metal shell defines a front-to-rear direction and a lateral direction perpendicular to the front-to-rear direction and includes a pair of elastic arms extending rearward from a rear edge thereof and a pair of latch portions extending along the lateral direction from free tips of the elastic arms. The insulative housing comprises a base portion and a mating portion extending forwardly from the base portion. The base portion defines a pair of protrusions extending along the lateral direction. The at least one terminal includes a contact portion disposed on the mating portion. The metallic shell is assembled to the insulative housing in the front-to-rear direction, the latch portions of the metal shell lock with the protrusions of the housing so as to secure the shell to the insulative housing.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
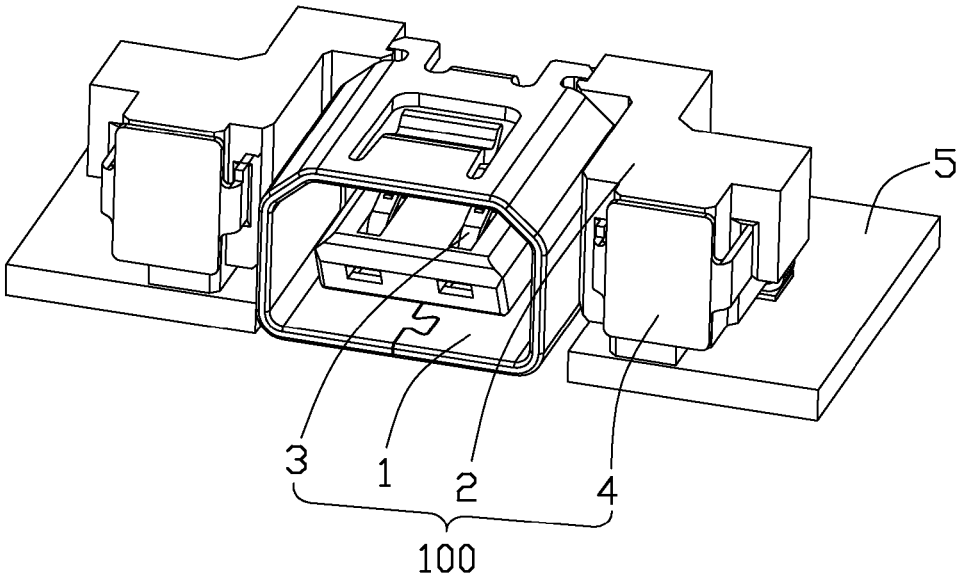
FIG. 1 is a perspective view of an electrical connector mounted on a PCB of the present invention.
Figure 2:
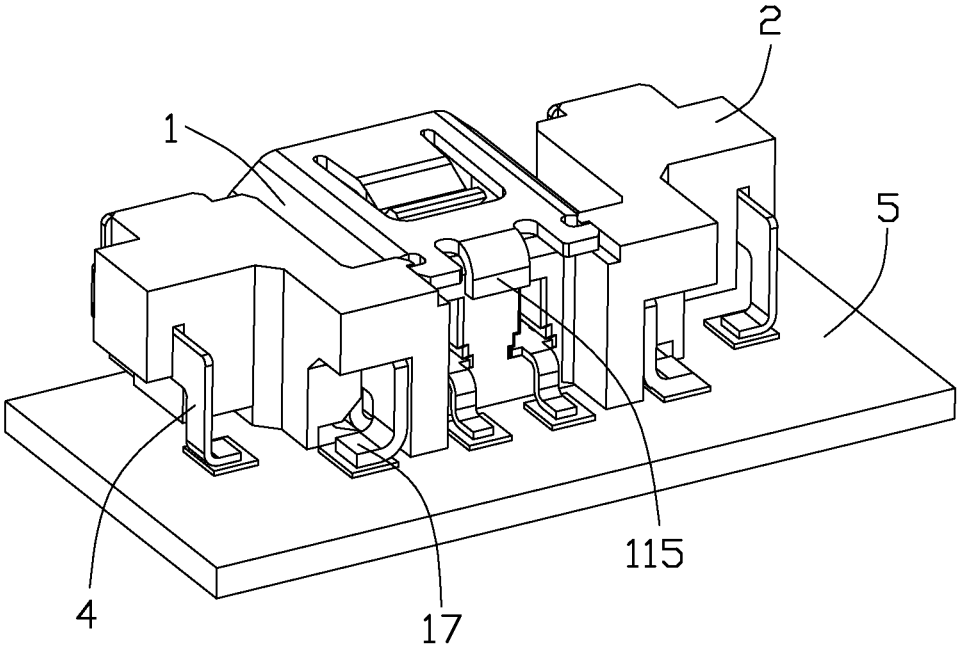
FIG. 2 is another perspective view of the electrical connector mounted on the PCB of FIG. 1.
Figure 3:
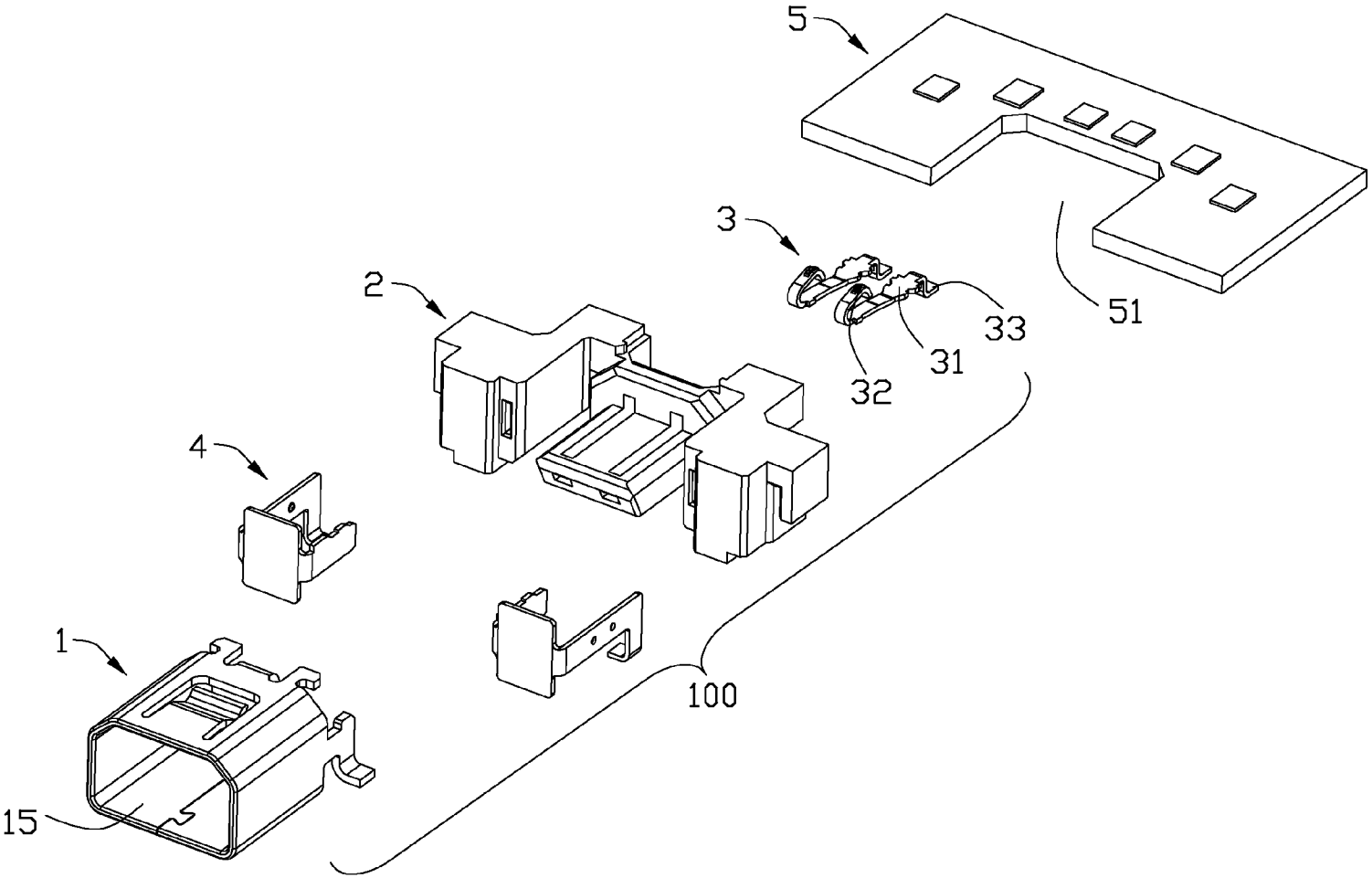
FIG. 3 is a perspective view of the electrical connector and the PCB of FIG. 1.
Figure 4:
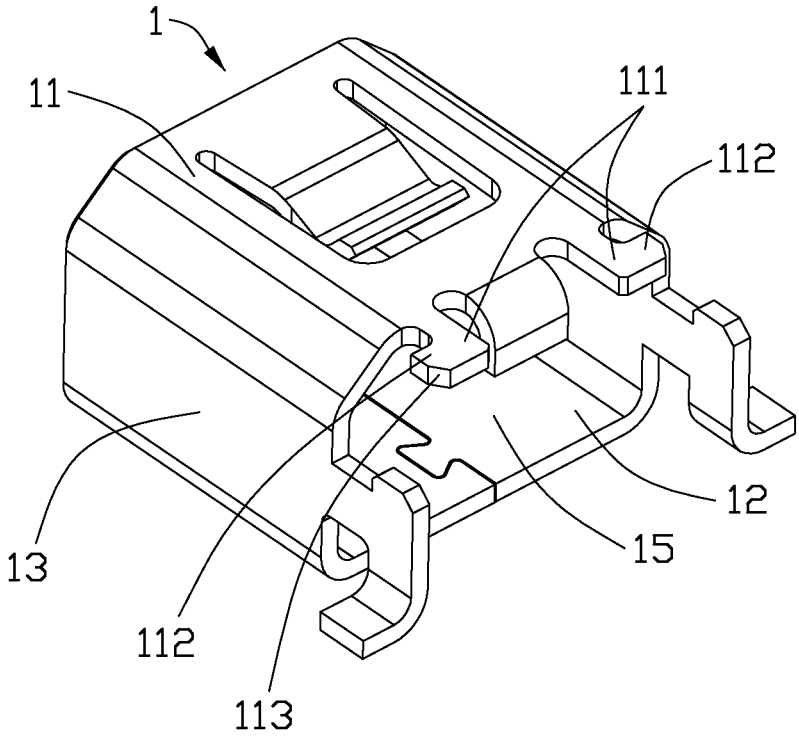
FIG. 4 is a perspective view of a metal shell of the electrical connector of FIG. 3.
Figure 5:
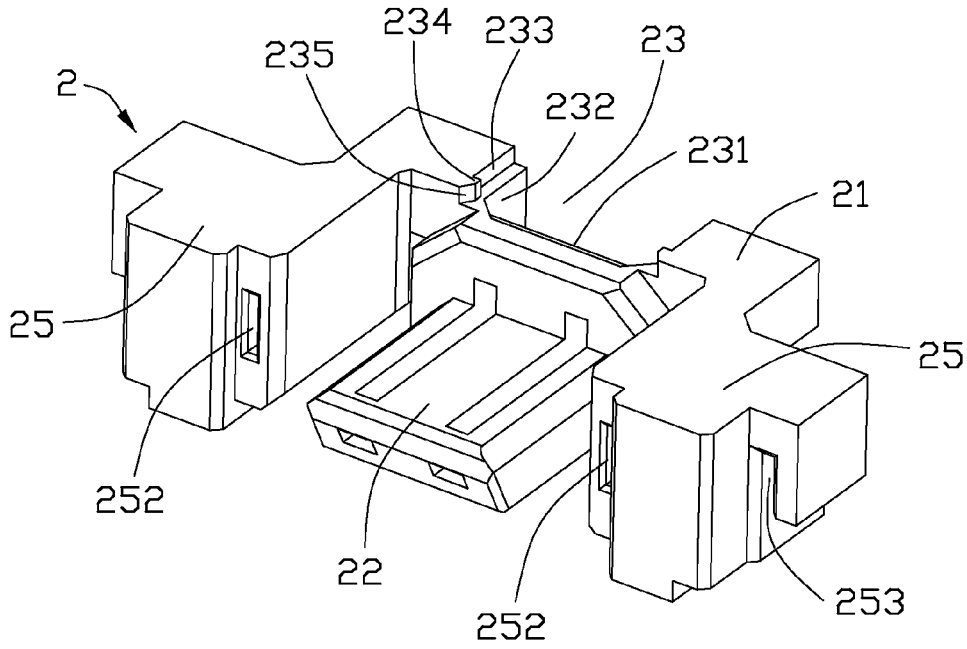
FIG. 5 is a perspective view of an insulative housing of the electrical connector of FIG. 3.
Figure 6:
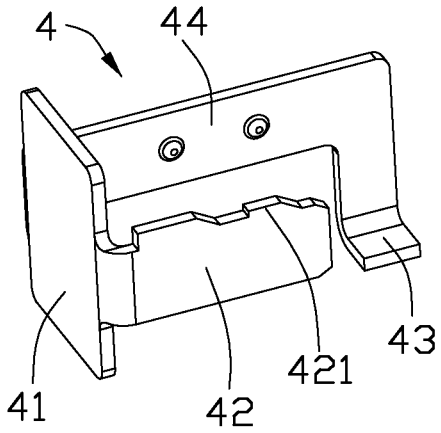
FIG. 6 is a perspective view of a second terminal of the electrical connector of FIG. 3.

Referring to FIGS. 1 and 2, an electrical connector 100 mounted on a printed circuit board (PCB) 5 comprises an insulative housing 2, a metal shell 1 enclosing the insulative housing 2, two first terminals 3 and two second terminals respectively secured in the housing 2.

Referring to FIGS. 3 to 6, the shell 1 comprises a top wall 11, a bottom wall 12 opposite to the top wall 11 and a pair of opposite side walls 13 respectively connecting the top wall 11 with the bottom wall 12. The shell 1 defines a receiving space 15 commonly enclosed by all said walls thereof. A pair of elastic arms 111 extends rearward from a rear edge of the top wall 11 and each comprises a latch portion 112 projecting outwardly at its free tip thereof.

The insulative housing 2 comprises a base portion 21 and a mating portion 22 extending forwardly and received in the receiving space 15. The base portion 21 has a notch 23 recessed in its rear surface and penetrating through opposite top and bottom surfaces. The notch 23 defines a pair of opposite end faces 232 and an inner face 231 connecting the end faces 232. The end faces 232 define a pair of stepped faces 233 recessed on upper ends thereof. A pair of protrusions 234 projects from front sections of the stepped faces 233 and not beyond the inner faces 231. The protrusions 234 define opposite chamfered portions 235 formed by obliquely cutting off an edge portion which is in the front of the protrusions 234. The latch portions 112 of the elastic arms 111 define a pair of chamfered areas 113 configured to mate with the protrusions 234. The shell 1 is mounted to the insulative housing 2 from front to rear and latched to the housing 2 by engagement of the latch portions 112 and the protrusions 234. The mating portion 22 is received in the receiving space 15 of the shell 1. The PCB 5 defines a cutout 51 aligned with the shell 1.

The first terminals 3 are mounted to the insulative housing 2 from rear to front and comprise retention portions 31 retained in the base portion 21, contact portions 32 located in the mating portion 22 and tail portions 33 soldered on the PCB 5. The contact portions 32 are bent toward the retention portions 31 and exposed to the receiving space 15.

Combined with FIG. 2, the shell 1 comprises a bent portion 115 bending downwardly and rearwardly from a rear edge of the top wall 11. The bent portion 115 is located between the two elastic arms 111 and abuts against the inner face 231 to secure the shell 1 more reliably. A pair of soldering tails 17 extends form rear edges of the side walls 13 of the shell 1 to be soldered on the PCB 5.

The insulative housing 2 further comprises a pair of extension portions 25 formed at two sides of the base portion 21. The mating portion 22 is located between the two extension portions 25 and spaced apart from the extension portions 25. The second terminals 4 are respectively assembled to the corresponding extension portions 25 from front to rear and comprise contact sections 41 located at front surfaces of the extension portions 25, retention sections 42 retained in the extension portions 25 and soldering sections 43 soldered on the PCB 5. The retention sections 42 have several barbs 421 at its edge thereof. The extension portions 25 have a pair of grooves 252 located at opposite inner sides. The barbs 421 interfere with inner walls of the grooves 252. A connection section 44 extending rearward from an outer side of the contact section 41 connects the contact section 41 with the soldering section 43 and received in a receiving slot 253 formed in an outer side of the extension portion 25.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a metal shell defining a front-to-rear direction and a lateral direction perpendicular to the front-to-rear direction and comprising a pair of elastic arms extending rearward from a rear edge thereof, a pair of latch portions extending along the lateral direction from free tips of the elastic arms;

an insulative housing comprising a base portion and a mating portion extending forwardly from the base portion, the base portion defining a pair of protrusions extending along the lateral direction; and at least one terminal comprising a contact portion disposed on the mating portion; wherein the metallic shell is assembled to the insulative housing in the front-to-rear direction, the latch portions of the metal shell lock with the protrusions of the housing so as to secure the shell to the insulative housing; wherein said two protrusions extend inward in opposite directions and two latch portions extend outward in opposite directions; wherein the protrusions define chamfered portions at front face thereof and the latch portions of the elastic arms define chamfered areas configured to guide the protrusions; wherein the base portion defines a notch recessed in its rear surface and penetrating through opposite top and bottom surfaces thereof, the metallic shell further comprises a bent portion bending from a rear edge thereof and abutting against an inner face of the notch.

2. The electrical connector as recited in claim 1, wherein the metallic shell further comprises a pair of soldering tails extending rearward to be soldered on the PCB.

3. An electrical connector, comprising:

a metal shell defining a receiving space;

an insulative housing comprising a base portion, a mating portion and a pair of extension portions extending forwardly from the base portion, the mating portion received in the receiving space and located between the extension portions;

a pair of first terminals comprising contact portions disposed on the mating portion and exposed to the receiving space; and a pair of second terminals comprising contact sections disposed on front surfaces of the extension portions; wherein the second terminals comprise retention sections extending rearward from inner sides of the contact sections and retained in the extension portion; wherein said extension portions have a pair of grooves formed at opposite inner sides thereof, said retention sections interfere with inner walls of the grooves; wherein the second terminals further comprise connection sections extending rearward from outer sides of the contact sections and soldering sections extending downwardly from tips of the connection sections.

4. An electrical connector for use with a printed circuit board, comprising:

an insulative housing defining a vertical base portion with a pair of extension portions at two opposite sides;

a protruding portion formed on a front face of the base portion and a mating portion forwardly extending from the protruding portion;

a plurality of contacts disposed in the housing with contacting sections exposed upon the mating portion;

a metallic shell defining a frame portion assembled to the housing in a front-to-back direction and compliantly enclosing said protruding portion and further surrounding said mating portion, a bottom plate of the frame of the shell being lower than bottom faces of the pair of extension portions, at least a locking arm extending rearwardly from the frame portion to lock the base portion once the shell is assembled to the housing in the front-to-back direction; wherein the shell defines a pair of mounting pads protectively located respectively under the corresponding extension portions for mounting to the printed circuit board; wherein the mounting pad define a vertical section connected to the frame, and a slit is formed between the base portion and the corresponding extension portion to allow said vertical section to pass during assembling the shell to the housing; wherein the base portion defines a notch in a rear face with mounting sections of the contacts located therein; wherein the mounting sections of the contacts and the mounting pads of the shell are essentially aligned with each other in a transverse direction perpendicular to said front-to-back direction of the housing.

5. The electrical connector as claimed in claim 4, further including a pair of terminals mounted upon the corresponding extension portions.

6. The electrical connector as claimed in claim 5, wherein the housing and the terminals are configured to allow the terminals to be assembled to the corresponding extension portions in said front-to-back direction.

7. The electrical connector as claimed in claim 5, wherein solder pads of the pair of terminals are located in front of the mounting pads of the shell and the mounting sections of the contacts in the front-to-back direction.

8. The electrical connector as claimed in claim 5, wherein the terminal defines a pair of vertical portions retained into the corresponding extension portion.

9. The electrical connector as claimed in claim 8, wherein a solder pad of the corresponding terminal extends from one of said pair of vertical portions.

10. The electrical connector as claimed in claim 9, wherein the pair of vertical portions includes an inner one and an outer one, and the solder pad extends from the outer one.

* * * * *